US006058855A

United States Patent [19]

Ake et al.

[11] Patent Number: 6,058,855

[45] Date of Patent: May 9, 2000

[54] LOW EMISSION U-FIRED BOILER COMBUSTION SYSTEM

[75] Inventors: Terence Ake, North Brookfield; Roderick Beittel, Worcester; Robert A. Lisauskas, Shrewsbury; Eric Reicker, Barre, all of Mass.

[73] Assignee: D. B. Riley, Inc., Worcester, Mass.

[21] Appl. No.: 09/119,097

[22] Filed: Jul. 20, 1998

[51] Int. Cl.[7] ..... F23C 3/00; F23C 9/06; F23G 7/06; F23L 9/04

[52] U.S. Cl. ..... 110/214; 110/186; 110/204; 110/208; 110/210; 110/216; 110/165 A; 110/263; 110/266

[58] Field of Search ..... 110/203, 204, 110/208, 210, 211, 212, 214, 216, 234, 165 A, 260, 261, 263, 265, 266, 264, 347, 345, 186; 122/4 D; 431/187, 348

[56] References Cited

U.S. PATENT DOCUMENTS

| | | | |
|---|---|---|---|
| 4,457,241 | 7/1984 | Itse et al. | 110/347 |
| 4,479,442 | 10/1984 | Itse et al. | 110/261 |
| 5,052,312 | 10/1991 | Rackley et al. | 110/264 X |
| 5,161,471 | 11/1992 | Piekos | 110/165 R |
| 5,291,841 | 3/1994 | Dykema | 110/347 |
| 5,496,170 | 3/1996 | Primdahl et al. | 431/187 |
| 5,687,657 | 11/1997 | Ziegler | 122/4 D |
| 5,730,071 | 3/1998 | Wasyluk et al. | 110/234 X |
| 5,878,700 | 3/1999 | Farzan et al. | 122/4 D |

FOREIGN PATENT DOCUMENTS

| | | | |
|---|---|---|---|
| 292 064 A5 | 7/1991 | German Dem. Rep. | 110/261 |
| 43 11 009 A1 | 10/1994 | Germany | 110/210 |

*Primary Examiner*—Ira S. Lazarus
*Assistant Examiner*—Ljiljana V. Ciric
*Attorney, Agent, or Firm*—Mason, Kolehmainen, Rathburn & Wyss

[57] ABSTRACT

At least one main combustion chamber contains at least one pulverized coal burner. Each pulverized coal burner is operatively arranged for minimizing $NO_X$ production and for maintaining a predetermined operating temperature to liquefy ash within the combustion chamber. The combustion chamber includes a slag drain for removing slag from the combustion chamber. A slag screen is positioned in a generally U-shaped furnace flow pattern. The slag screen is positioned between the combustion chamber and a radiant furnace. The radiant furnace includes a reburning zone for in-furnace $No_X$ reduction. The reburning zone extends between a reburning fuel injection source and at least one overfire air injection port for injecting air.

8 Claims, 3 Drawing Sheets

LOW EMISSION U-FIRED BOILER COMBUSTION SYSTEM

This invention was made with Government support under contract No. DE-AC22-92PC92158 awarded by the United States Department of Energy. The United States Government has certain rights in this invention.

FIELD OF THE INVENTION

The present invention generally relates to pulverized coal boiler systems, and more particularly, relates to a low emission U-fired boiler combustion system.

DESCRIPTION OF THE RELATED ART

A problem with many pulverized coal boiler systems is the production of oxides of nitrogen in the combustion process. A need exists to provide efficient boiler operation while reducing the formation of $NO_X$ and particulate emissions.

U.S. Pat. Nos. 4,457,241 and 4,479,442 disclose an improved burner for pulverized coal and method of burning pulverized coal and other fuels which reduces the amount of oxides of nitrogen (NOX) formation. A tubular venturi nozzle receives a primary flowing stream of pulverized coal and air for discharge into a combustion zone of a furnace for burning. A pulverized coal flow spreader including a plurality of swirl vanes is located near an outlet of the venturi nozzle to impart a low swirl and stabilizes an annular pattern of the coal and air stream discharged into the combustion zone of the furnace.

As environmental restrictions become more stringent, the costs of conventional flyash disposal are expected to increase since more sophisticated landfill containment systems will be required to protect groundwater from trace metal contamination. It is desirable to use a slag-tap boiler that operates at a sufficiently high temperature to melt ash material, extracted from the boiler and converted to vitrified slag. However, due to the higher combustion temperatures required to operate slag-tap systems in conventional designs the formation of $NO_X$ is increased as compared to emissions of dry-fired systems that operate below a flyash melting temperature.

A need exists for a low emission combustion firing system that utilizes advanced slagging combustion technology to meet growing worldwide demand for clean efficient electric generating capacity. The rapid rise in worldwide energy consumption and subsequent increase in utilization of fossil fuel resources, gives added impetus to the development of technology to help mitigate global climate change associated with greenhouse gas emissions. This is especially important considering that electric generating plants under construction today will continue to operate well into the next century.

SUMMARY OF THE INVENTION

A principal object of the present invention is to provide an improved low emission U-fired boiler combustion system. Other objects of the invention are to provide a low emission U-fired boiler combustion system that provides effective, efficient and reliable operation, and that overcomes some disadvantages of prior art arrangements.

In brief, a U-fired boiler combustion system includes at least one main combustion chamber. Each main combustion chamber contains at least one pulverized coal burner. Each pulverized coal burner is operatively arranged for minimizing $NO_X$ production and for maintaining a predetermined operating temperature to liquefy ash within the combustion chamber. The combustion chamber includes a slag drain for removing slag from the combustion chamber. A slag screen is positioned in a generally U-shaped furnace flow pattern. The slag screen is positioned between the combustion chamber and a radiant furnace. The radiant furnace includes a reburning zone for in-furnace $No_x$ reduction. The reburning zone extends between a reburning fuel injection source and at least one overfire air injection port for injecting air.

BRIEF DESCRIPTION OF THE DRAWING

The present invention together with the above and other objects and advantages may best be understood from the following detailed description of the preferred embodiments of the invention illustrated in the drawing, wherein.

DETAILED DESCRIPTION OF THE PREFERRED EMBODIMENTS

Figure 1:
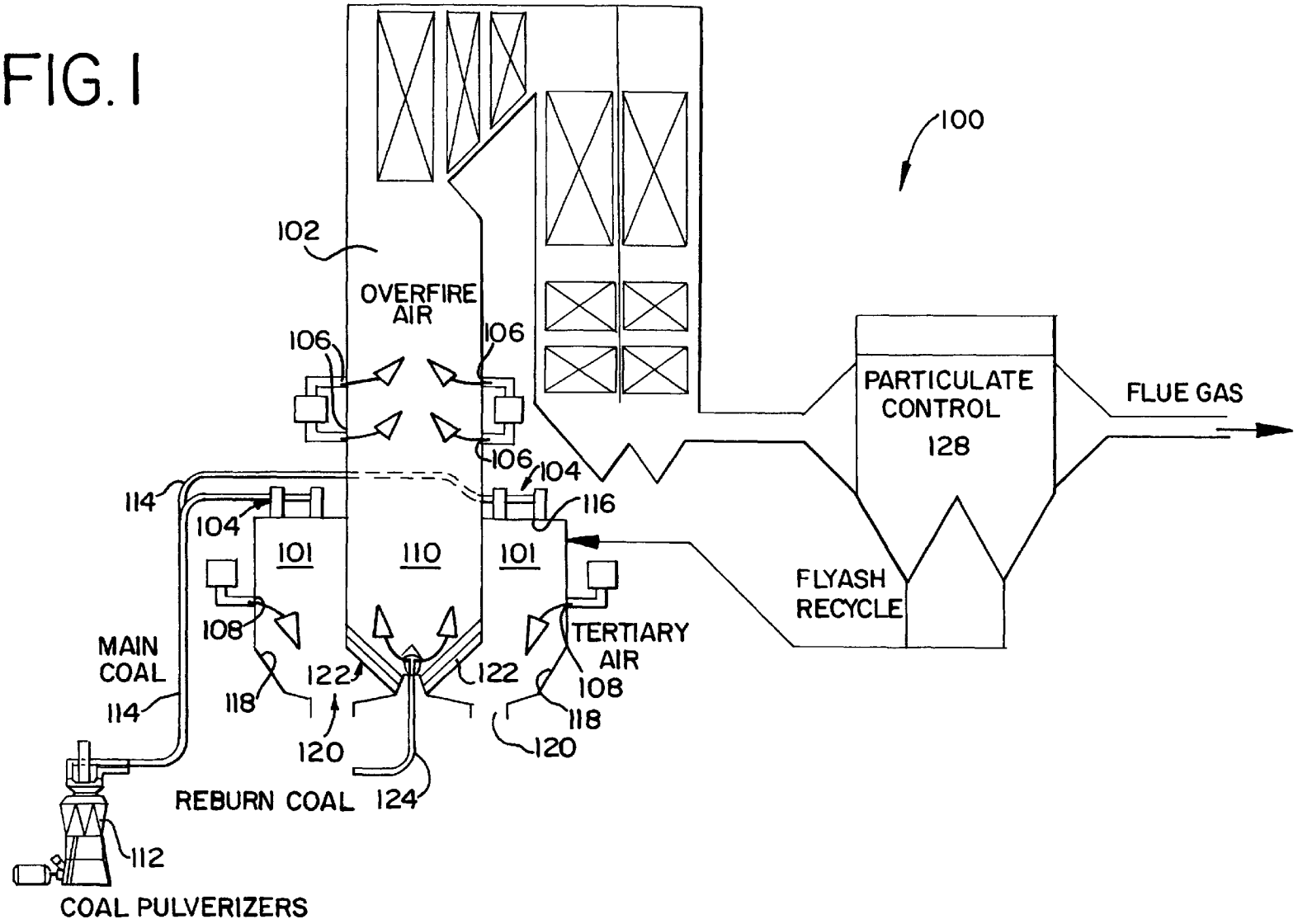
FIG. 1 is a diagrammatic view of a low emission U-fired boiler combustion system arranged in accordance with the present invention.

Having reference now to the drawing, FIG. 1 illustrates a low emission, U-fired combustion system generally designated by reference character 100 in accordance with the present invention. As shown in FIG. 1, U-fired combustion system 100 includes a pair of combustion chambers 101 positioned on each side of the radiant furnace 102. It should be understood that a single combustion chamber 101 positioned on one side of the radiant furnace 102 could be used. The utility of the present invention is not restricted to the dual combustion chamber arrangement.

The low emission, U-fired combustion system 100 includes an advanced slagging design which integrates low-$NO_X$ burners 104, air staging at multiple staging air injection ports including overfire air ports 106 and optional tertiary air ports 108 and coal reburning at a reburning zone generally indicated by reference character 110.

In accordance with features of the invention, system 100 produces low emissions and provides improved solid waste management capabilities to meet increasingly stringent regulations for coal fired boilers. U-fired combustion system 100 is a slag-tap boiler system converting coal ash to a vitrified granulate with a higher potential for by-product utilization. In addition to providing a versatile raw material for coal ash by-product markets, fugitive dust emissions from ash handling systems are reduced and slag storage and disposal requirements are simplified due to the size and leaching characteristics of the material. U-fired combustion system 100 achieves combustion control of nitrogen oxides ($NO_X$) through the application of the low-$NO_X$ coal burners 104, air staging and reburning to the U-fired boiler design. U-fired combustion system 100 combines $NO_X$ combustion control technologies in a high temperature U-fired furnace environment to achieve low $NO_X$ emissions, such as 0.2 pounds per million British thermal units (Btu) of heat input or less. Heat input is based on the higher heating value of the fuel.

U-fired combustion system 100 utilizes a slag-tap, generally U-shaped firing system arrangement. At least one coal pulverizer 112 provides pulverized coal to the low $NO_X$ coal burners 104 through a respective main coal pipe 114. Each combustion chamber 101 may contain a single low $NO_X$ coal burner 104 or multiple low $NO_X$ burners 104. The burners 104 are mounted on the roof 116 of the combustion chamber 101 or on a downward facing arch of combustion chamber 101. The low $NO_X$ coal burners 104 are downwardly facing burners. U-fired combustion system 100 has a generally U-shaped furnace flow pattern downwardly through the combustion chamber 101 and then upwardly in the radiant furnace 102.

A controlled combustion venturi nozzle burner assembly of the type described in U.S. Pat. Nos. 4,457,241 and 4,479,442, respectively issued Jul. 3, 1984 and Oct. 30, 1984 and assigned to the present assignee, advantageously can be used for the low $NO_X$ pulverized coal burners 104.

Figure 2:
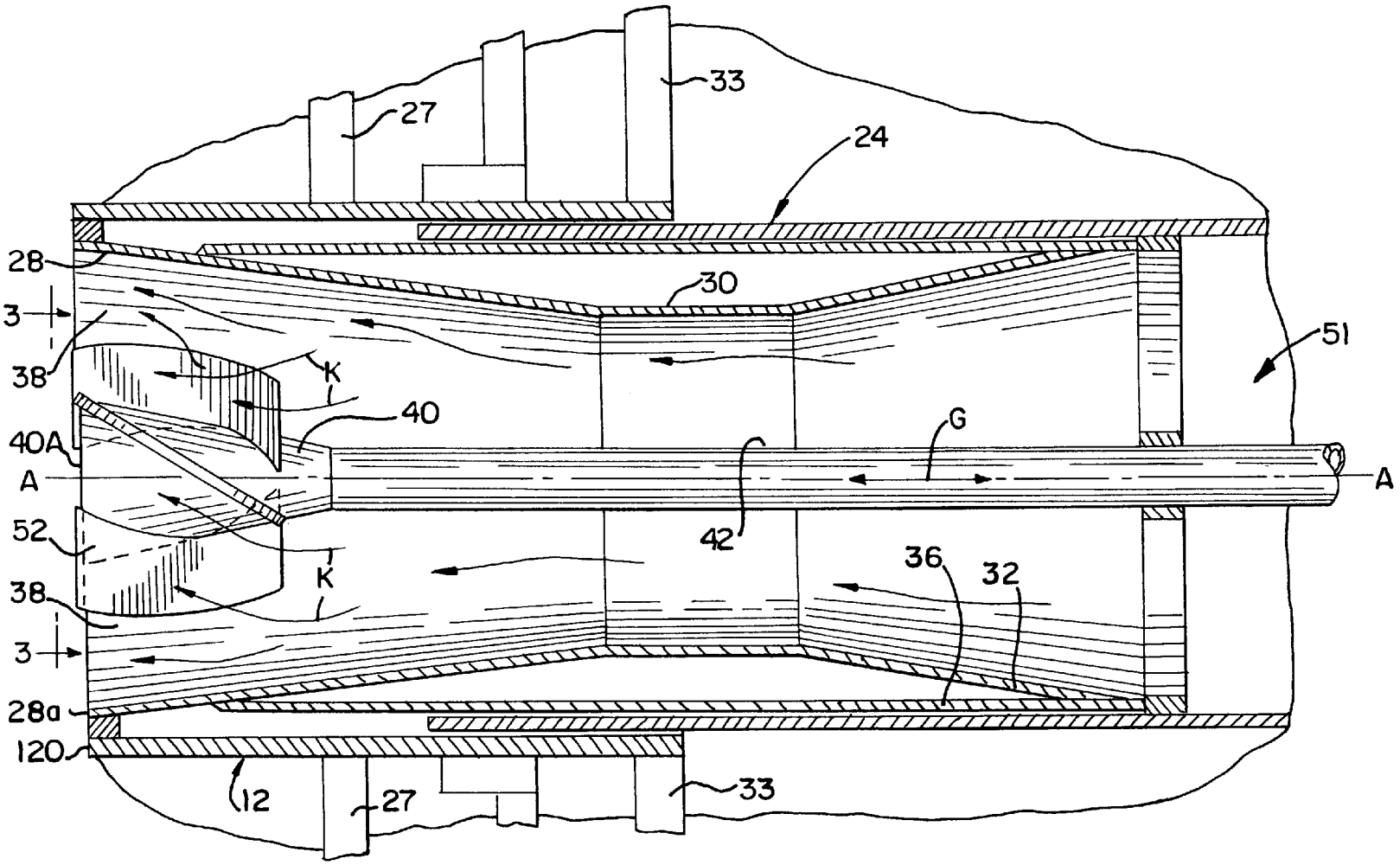
FIG. 2 is a cross sectional view of a pulverized coal burner nozzle of a burner assembly of the combustion system of FIG. 1.
Figure 3:
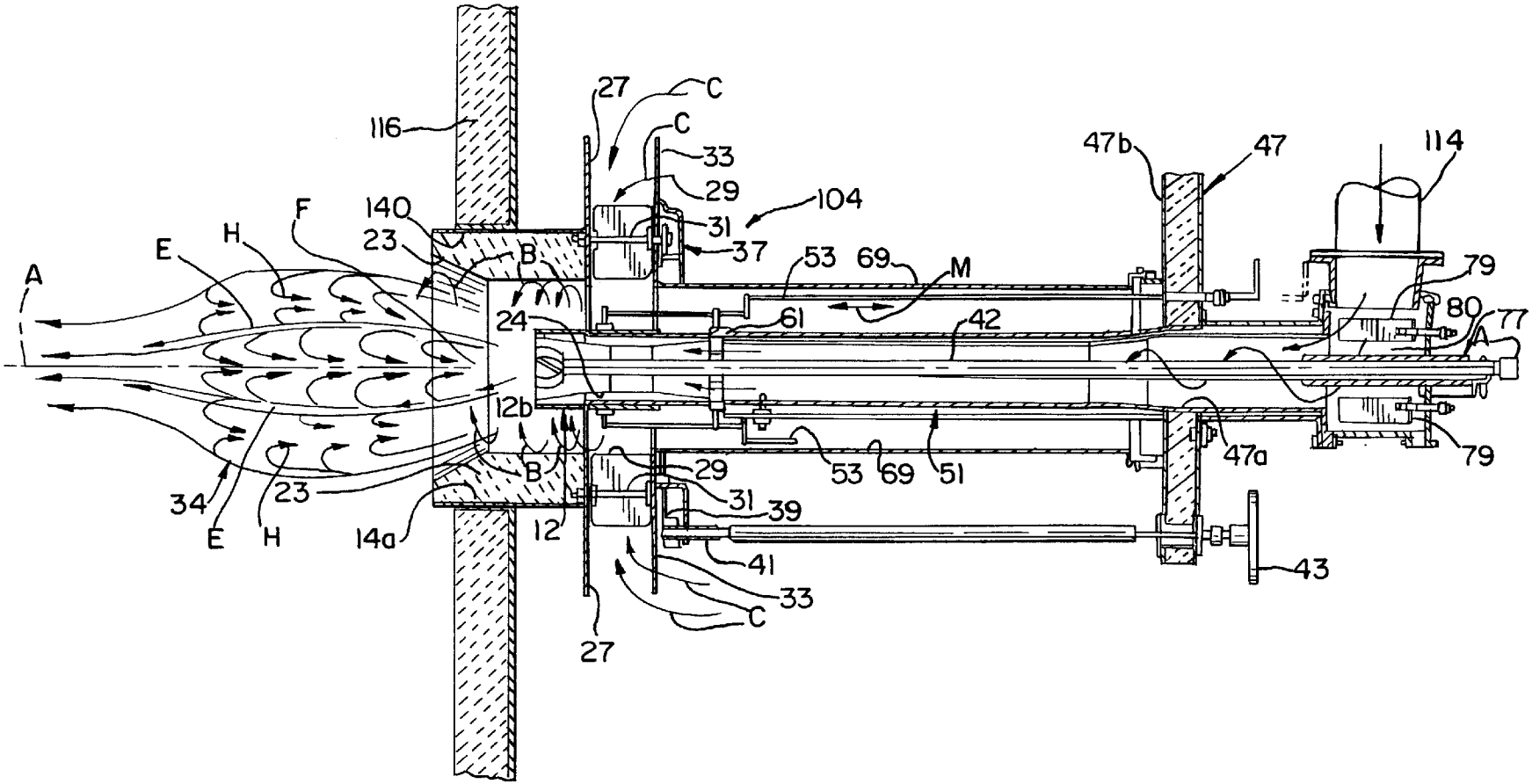
FIG. 3 is a cross sectional view of a burner assembly of the combustion system of FIG. 1.

Referring now to FIG. 2, there is illustrated a venturi nozzle 24 for burning pulverized coal. A burner assembly 104 including the burner nozzle 24 is illustrated in FIG. 3. The burner nozzle 24 includes a primary, hollow, tubular, discharge conduit or nozzle 12, preferably formed of steel with a circular, transverse cross-section, mounted to extend downwardly into an opening 14*a* formed in the roof wall 116. The venturi nozzle 24 discharges pulverized coal and primary air into the frusto-conical burner throat 23 and swirling secondary air is introduced into the throat in the annular space surrounding the venturi nozzle 12 along flow lines "B". The swirling action of the secondary air is imparted by a plurality of swirl vanes 29 which are mounted on rotatable support axles 31, extending between the front and rear annular plates 27, 33 of the secondary air register which surrounds the burner assembly 10, and supplies air indicated by arrows C between plates 27, 33.

The vanes 29 are collectively controlled to pivot in unison and for this purpose, a vane ring control assembly 37 is provided adjacent the outer surface of the outer register plate 33. A chain and sprocket drive system 39 driven and controlled by a shaft 41 and a handwheel 43 positioned outside of the burner front 41 is provided for selectively adjusting the angle of the vanes 29.

The burner front 47 is formed with a central opening 47*a* in order to accommodate a primary coal/air supply conduit 51 which supplies a flow of pulverized coal and primary air to the burner nozzle 12. As viewed in FIG. 3, a left-hand (inner) end portion of the supply conduit 51 also provides support for the burner nozzle 12 which is mounted for telescopic longitudinal sliding movement thereon. Control of the relative longitudinal position of the nozzle on the supply conduit is attained through two control rods 53 movable in the directions indicated by arrows "M". A cylindrical burner barrel 69 is mounted in coaxial alignment with the primary supply conduit 51 to extend between the secondary air register plate 33 and the burner front 47. The incoming flow of the primary coal/air mixture from the supply pipe 114 is directed into the burner nozzle head 80. The plurality of adjustable vanes 79 in the burner nozzle head are used to uniformly distribute the coal/air mixture in the coal nozzle head 80.

The venturi nozzle 24 in FIG. 2 provides a shallow sloped venturi structure having a generally frusto-conically shaped, divergent, nozzle outlet section 28 secured at its minimum diameter (inner) end to a cylindrical, intermediate, throat section 30. The inlet of the venturi nozzle is a frusto-conically-shaped, inlet or convergent, nozzle section 32 having a minimum diameter (inner) end joined to the upstream end of the intermediate throat section 30. The maximum diameter, upstream end of the convergent nozzle section 32 is mounted within the inside wall surface of the conduit 51 and is secured to a cylindrical shell 36. The flame pattern issuing from the burner 10 is indicated in an animated fashion in the drawings and is referred to generally by the reference numeral 34 in FIG. 3.

As the coal/air mixture flows through the venturi nozzle the coal particles in the stream are concentrated toward the central portion of the flowing stream and are more uniformly distributed in the primary fuel/air mixture. The venturi nozzle provides an inner shell (arrows E) of coal and air formed around the outside of a central, or inner recirculation zone F. This recirculation zone is formed at the end of the conical coal spreader 40. The resulting discharge pattern is shown by the divergent arrows E (FIG. 3) which graphically illustrate a generally shallow, frusto-annular discharge pattern of the fuel/air stream as it enters the combustion zone within the combustion chamber 101.

The venturi nozzle 24 includes a frusto-conically shaped, hollow, divergent flow spreader 40, shown in FIG. 2, mounted in coaxial alignment within the divergent section 28 venturi nozzle. The slopes of the venturi nozzle divergence section 28 and coal spreader 40 define an annular, generally frusto-conically shaped flow passage 38 for directing the discharge of the coal/air stream outwardly into the combustion zone in a shallow, frusto-conical shaped discharge pattern as indicated by the arrows E in FIG. 3.

The angle of convergent slope in section 32 is somewhat greater than the angle of divergence in the section 28. The small diameter end of the conical flow spreader 40 is supported and secured at the outer end of the central support tube 42 mounted in coaxial alignment on the center axis A—A in the burner nozzle 12. The support tube is moveable longitudinally in axial sliding movement in either direction as indicated by the arrows "G" (FIG. 2) by positioning of the outer end in the packing gland 77.

When the spreader cone 40 is moved inwardly (toward the right as shown in FIG. 3) the annular flow area 38 and the flow cross-section of the divergent discharge stream of coal/air mixture may be reduced slightly as the spreader cone is moved closer and closer to the throat section 30 of the venturi-like, flow constrictor 24. Conversely, when the support tube 42 is moved in an opposite direction (to the left), the flow area is increased. The velocity of the stream discharged from the outlet end 28*a* of the divergent flow section 28 may be readily controlled by movement of the spreader cone relative to the flow constrictor 24.

In order to stabilize combustion, venturi nozzle section 28 is provided with a plurality of swirl vanes 52 mounted on the outer surface of the spreader cone 40. These vanes impart a swirling action (arrows K, FIG. 2) to the primary coal/air stream in the passage 38 between the spreader cone and the inside surface of the divergent nozzle section 28 adjacent the outlet end 28*a*. The swirling action of the discharging coal/air stream imparted by the swirl vanes 52 increases the stability of the flame pattern 34 in the combustion zone and in the area immediately adjacent the outlet end 12*b* of the nozzle 12.

The swirling primary coal/air stream forms a wall surrounding a stagnant area (labeled F in FIG. 3), immediately adjacent the hollow outer end of the cone 40. The stagnant area F has a relatively low pressure and provides a reducing atmosphere of high temperature resulting in the volatiles in the pulverized coal being driven off and burned with minimal formation of oxides of nitrogen or $NO_X$. This is accomplished because of the reducing atmosphere, and the high temperatures in this area.

The proper matching of velocities between swirling secondary air (arrows B) and the swirling primary coal/air stream E discharged from the outlet end of the burner nozzle 12 provides a second or outer recirculation zone H of torroidal configuration outside and around the stagnant area F. The entry of secondary or outside air into the primary coal/air mixture is minimized so that a reducing atmosphere of high temperature is maintained. The concentric inner and outer recirculation zones cause a portion of the combustion products to be drawn back towards the burner nozzle outlet 12*b* as indicated by the inner and outlet flame path arrows. A rapid devolitilization and combustion of the coal is thus accomplished without forming excessive quantities of oxides of nitrogen (NOX) which are polluting to the atmosphere.

The convergent or entry section 32 of the venturi nozzle 24 tends to concentrate the coal particles toward the central portion of the accelerating coal/air stream and evenly distributes the coal in the primary flow. This stream passes into a condition of low pressure and high velocity in the throat section 30 and subsequently, the coal/air stream is decelerated while forming an annularly shaped, swirling flow pattern around the hollow spreader cone 40. The annular stream is caused to swirl by the swirl vanes 52 in the outlet passage 38 between the confining annular surfaces of the spreader cone 40 and the inner surface of the divergent nozzle section 28. The swirling action tends to stabilize combustion. The swirling action also helps to establish the stagnation area F early in the combustion process at the open end of the spreader cone 40. In this area volatiles in the coal are evolved and burned in a high temperature, reducing atmosphere without significant formation of oxides of nitrogen.

The low $NO_X$ burners 104 are designed to separate the secondary burner air streams from the primary coal air stream to control the fuel air mixing process in the combustion chamber 101. Conditions in the combustion chamber 101 must be such that not only is a stable flame achieved when the burners 104 are operated fuel rich to minimize $NO_X$ formation, but also such that local temperatures are high enough throughout the combustion chamber to liquefy the ash to a sufficiently low viscosity that it will flow down the combustion chamber walls 118 and be extracted or tapped easily from the combustion chamber 101 at a slag drain 120. Slag-tap furnaces are designed to operate at temperatures at, or above, the melting point of the ash or mineral matter contained in the coal. The ash that is collected in the bottom hopper of the furnace is extracted or tapped from the chamber in a molten or fluid state. Slag-tap furnaces are alternately known as wet-bottom furnaces. After leaving the slag tap 120, the liquid phase ash is quenched and resolidified into a fused or vitrified material.

The temperature at the bottom of the combustion chamber 101 is equal to or greater than the temperature corresponding to the maximum viscosity at which the liquid phase slag can be tapped from the furnace. This temperature varies with coal type, depending on the composition of the ash. Practical operating experience has shown that the upper viscosity limit for the fluidity of slag is approximately 250 poise.

The low $NO_X$ burners 104 fire downwardly into the refractory lined combustion chamber 101. Slag is collected and tapped at the slag drain 120 in the bottom of the chamber 101 where the gases turn upwardly through a slag screen 122 into the radiant furnace 102. The combustion chambers 101 and radiant furnace 102 are separated by the slag screen 122 consisting of widely spaced boiler tubes. These water-cooled tubes of slag screen 122 receive heat by radiation from the furnace and convection from the combustion gas passing through the tube screen 122. In addition to shielding the radiant furnace 102 from the combustion chamber slag tap, the slag screen 122 helps to retain ash in the high temperature combustion chamber 101. After the slag screen 122, coal or other reburn fuel 124 is injected with final burnout air injected at the multiple overfire air ports 106.

Reburning is another key $NO_X$ control technique utilized in the low-$NO_X$ U-fired combustion system 100. In general, reburning is a combustion modification technology, which removes $NO_X$ from combustion products using fuel as the reducing agent. Reburning may alternately be known as in-furnace $NO_X$ reduction or staged fuel injection. In the U-fired combustion system 100, U-fired reburning involves the injection of reburn coal 124 or other fuel in the lower furnace 102. The reburn coal injection 124 may be provided either before or after the slag screen 122 separating the combustion chamber 101 from the radiant furnace 102. A gaseous or liquid fuel may be substituted for pulverized coal as the reburn fuel. The amount of reburn fuel injected can range from 5% to 30% of the total fuel heat input to the the combustion chamber 101 and the radiant furnace 102.

Final air for burnout of the remaining fuel fragments is injected into the upper radiant furnace through overfire air ports 106. Overfire air may be introduced at one or more elevations in the radiant furnace 102 to create an oxidizing or fuel lean condition for burnout. The region between the reburning fuel injection location 124 and first level of overfire air in the radiant furnace 102 is defined as the reburning zone 110. Air and fuel flows are controlled so that the reaction of fuel and gases in the reburning zone occur under fuel rich conditions. The average gas phase residence time in the high temperature fuel rich reburning zone 110 for low $NO_X$ U-fired system ranges from 0.5 to 2.5 seconds.

The portion of ash in the pulverized coal which is not removed as slag from the combustion chambers 101 and is entrained in the flue gas leaving the furnace 102, is commonly called flyash. A particulate control device 128, such as a baghouse or precipitator, collects flyash. Collected flyash may, if desired, be reinjected back into the combustion chamber 101. In this mode of operation, nearly all of the coal ash can be removed as vitrified slag and high overall carbon conversion is achieved.

The invention also includes several options, which may lead to additional $NO_X$ reductions. These include introducing recirculated flue gas into the secondary air streams of the burners or employing external air staging. Air staging involves introducing a portion of the combustion air through the tertiary air ports 108 in the U-fired combustion chamber walls 118.

While the present invention has been described with reference to the details of the embodiments of the invention shown in the drawing, these details are not intended to limit the scope of the invention as claimed in the appended claims.

What is claimed is:

1. A combustion system comprising:

a supply of pulverized coal;

a radiant furnace;

a generally U-shaped firing region including a downward leg, a bottom portion and an upward leg extending toward said radiant furnace;

said downward leg including a main combustion chamber including a roof, said main combustion chamber containing at least one pulverized coal burner mounted to said roof and firing downwardly into said main combustion chamber;

a conduit supplying pulverized coal from said supply to each of said at least one pulverized coal burner;

a slag drain at the bottom of said U-shaped firing region for removing slag from said combustion chamber;

an upwardly firing reburning zone in said upward leg of said U-shaped firing region;

a reburn fuel injection passage extending to said reburning zone; and at least one overfire air injection port disposed above said reburning zone for injecting air into said radiant furnace.

2. A combustion system as recited in claim 1 wherein air and fuel flows are controlled to provide fuel rich conditions in said reburning zone.

3. A combustion system as recited in claim 1 wherein an average gas phase residence time in said reburning zone is in a range between 0.5 seconds and 2.5 seconds.

4. A combustion system as recited in claim 1 further including a particulate control device communicating with said radiant furnace for collecting flyash entrained in flue gas exiting said radiant furnace.

5. A combustion system as recited in claim 1 including a pair of said generally U-shaped firing regions and a pair of said main combustion chambers located on opposite sides of said radiant furnace.

6. A combustion system as recited in claim 1 wherein said radiant furnace includes a plurality of said overfire air injection ports.

7. A combustion system as recited in claim 1 further comprising a slag screen located at the bottom of said U-shaped firing region between said slag drain and said reburning zone.

8. A combustion system as recited in claim 1, including a plurality of said pulverized coal burners mounted to said roof and firing down into said main combustion chamber.

* * * * *